US007380880B2

(12) United States Patent
Molen

(10) Patent No.: US 7,380,880 B2
(45) Date of Patent: Jun. 3, 2008

(54) FREE STANDING SEATING SUSPENSION FRAME

(76) Inventor: Roger Vander Molen, 68757 Territorial Rd., Lawrence, MI (US) 49064

( * ) Notice: Subject to any disclaimer, the term of this patent is extended or adjusted under 35 U.S.C. 154(b) by 278 days.

(21) Appl. No.: 11/221,554

(22) Filed: Sep. 8, 2005

(65) Prior Publication Data

US 2006/0061165 A1 Mar. 23, 2006

Related U.S. Application Data

(60) Provisional application No. 60/607,924, filed on Sep. 8, 2004.

(51) Int. Cl.

| | |
|---|---|
| ***A63G 9/00*** | (2006.01) |
| ***A45F 3/22*** | (2006.01) |
| ***A45F 3/24*** | (2006.01) |
| ***A47B 91/00*** | (2006.01) |

(52) U.S. Cl. ..... 297/273; 297/277; 5/120; 5/127; 5/129; 248/188.7

(58) Field of Classification Search ..... 297/273, 297/276, 277; 5/120, 127, 128, 129; 248/188.7
See application file for complete search history.

(56) References Cited

U.S. PATENT DOCUMENTS

| | | | | |
|---|---|---|---|---|
| 459,670 | A * | 9/1891 | Barnhart | 297/273 X |
| 679,963 | A * | 8/1901 | Hayward | 5/129 |
| 3,344,443 | A * | 10/1967 | Bounell | 5/120 |
| 3,528,657 | A * | 9/1970 | Krupsky | 297/277 X |
| 3,730,587 | A * | 5/1973 | Bloxham et al. | 297/274 |
| D230,109 | S * | 1/1974 | Gass | D6/499 |
| D249,408 | S * | 9/1978 | Jackson | D6/347 |
| 4,221,429 | A * | 9/1980 | Wade | 297/277 |
| 4,238,097 | A * | 12/1980 | Clausen et al. | 248/188.7 |
| 5,097,545 | A * | 3/1992 | Hooi | 5/127 X |
| 5,588,702 | A * | 12/1996 | Litwin | 297/277 |
| 6,748,616 | B1 * | 6/2004 | Tseng | 5/120 X |
| 6,854,801 | B2 * | 2/2005 | Nussbaum | 297/279 |
| 7,040,995 | B2 * | 5/2006 | Lee | 5/120 X |
| 7,073,857 | B1 * | 7/2006 | Bailey | 297/273 X |
| D531,826 | S * | 11/2006 | Nutsos | D6/347 |
| D548,472 | S * | 8/2007 | Habing et al. | D6/347 |
| D548,500 | S * | 8/2007 | Bailey | D6/499 |
| 2003/0209927 | A1 * | 11/2003 | Nussbaum | 297/273 |

* cited by examiner

*Primary Examiner*—Rodney B. White
(74) *Attorney, Agent, or Firm*—The Weintraub Group, PLC

(57) ABSTRACT

A free standing frame for suspending a seat therefrom and for relative back and forth swinging thereto, comprises a support base wherein a pair of rear legs are longer than a pair of front legs to provide stability, a pair of frame sections that are assembleable to form a banana or C-shaped frame centered above the rear legs and having an upper end for suspending a seat and a lower end, and means for connecting the lower end of the frame to the base and orienting the frame and the center of gravity relative to the rear legs.

16 Claims, 4 Drawing Sheets

FREE STANDING SEATING SUSPENSION FRAME

CROSS REFERENCE TO RELATED APPLICATIONS

This is a Completion Patent Application of co-pending U.S. Provisional Patent Application 60/607,924, filed Sep. 8, 2004, for "Free Standing Seating Suspension Frame", the disclosure of which being incorporated herein in its entirety.

BACKGROUND OF THE INVENTION

1. Field of the Invention

The present invention pertains to a frame for suspending a seat or seating device therefrom. More particularly, the present invention pertains to a free standing frame for suspending a seat or the like therefrom. Even more particularly, the present invention pertains to a frame for above ground suspension of a chair or other seating device.

2. Description of Related Art

Heretofore, there have been provided frames for above ground suspension of seating devices such as canvas-backed or similar cloth-like chairs. Such devices, by suspending a seat along a vertical axis, provide the same type of relaxation mode as a hammock but in a much more compact area.

These frames have been substantially C-shaped, one-piece members having a ground-engaging base. However, one piece frames create difficulties in packaging and shipping. Previous attempts to make multi-component frames have not met with great success because of stability issues and the like.

The present invention, as is detailed hereinafter, overcomes these deficiencies in the prior art by providing a multi-component frame for suspending a seating device therefrom which is easily packaged for shipping and, concurrently, enables stability in use.

DESCRIPTION OF THE PREFERRED EMBODIMENT

Figure 1:
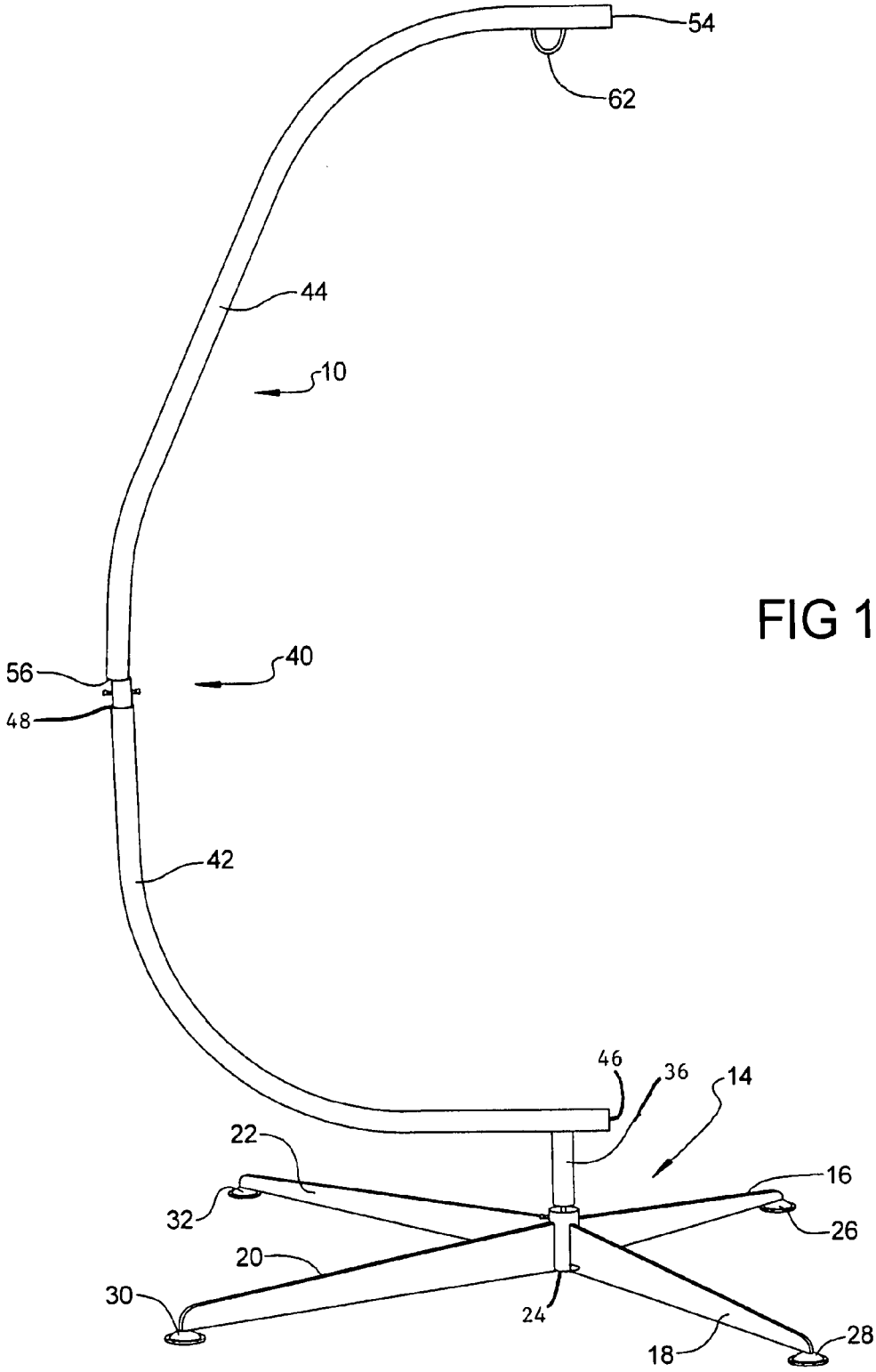
FIG. 1 is a perspective view of a frame assembly, according to this invention, for suspending a chair or seating device above the ground and for a front to rear pendular motion relative to the frame assembly when supported on the ground.
Figure 5:
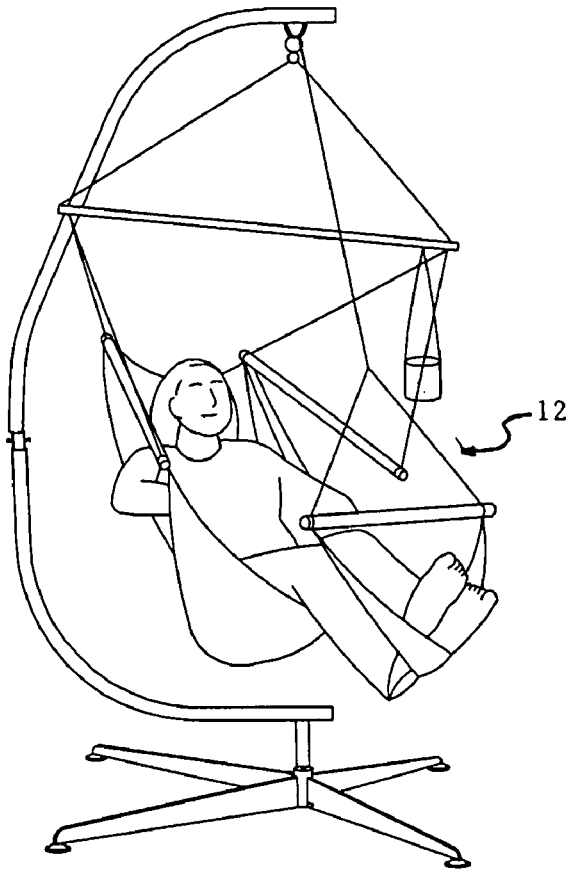
FIG. 5 is a perspective view of the frame hereof, in use, with a seating device suspended therefrom.

Referring to the drawings, FIGS. 1 and 5 illustrate a frame assembly, generally indicated at 10, according to the present invention, for suspending a chair or seating device, generally indicated at 12, above the ground and for a front to rear pendular motion relative to the frame assembly when the frame assembly is supported on the ground.

FIG. 5 illustrates the seating device and user relative to the frame assembly with the center of gravity initially being disposed on a vertical drawn between the base and the means for anchoring the seating device to the frame assembly.

It should be noted at the outset that the seating device 12, itself, does not form part of the present invention but, rather, any suitable seating device or chair that can be suspended from the frame assembly may be used herein. However, in the practice of the present invention, it is preferred to use a soft material type chair or a canvas-backed chair which uses ropes for suspension and dowels for support. Such latter canvas-backed chairs are well known and commercially available such as those sold by Hang It Up Products, LLC, under the name "Air Chair."

Referring to FIG. 1, the frame assembly 10 comprises a ground engaging base 14, and a substantially banana or C-shaped tubular frame element 40. The base 14 comprises a central post 24 and a plurality of leg members or spokes 16, 18, 20 and 22, each leg member radiating outwardly from the central post 24.

The central post 24 is a generally cylindrical member formed from any suitable material such as steel or the like. The central post 24 has upper and lower opposite end faces, a cylindrical interior bore, and a generally cylindrical exterior wall. The interior and exterior walls of the central bore and exterior wall of the post body are generally coaxial with one another and centered on an axis extending between the opposite end faces of the of the post body. As will be described herein below, the bore defines an interior chamber used in mounting the frame 10.

Preferably, the central post 24 has a pair of vertically separated threaded registering apertures 72 and 74. The apertures 72 and 74 extend radially relative to the central axis and between the outer or exterior wall of the post body and open into the bore of the post 24. The aperture 72 is proximate to the top or upper end face of the post body and the aperture 74 is proximate to the bottom or lower end face of the post body.

Preferably, the legs or spokes 16, 18, 20 and 22 radiate outwardly from the exterior outer wall of the post 24 and along a respective radius passing through the central vertical axis thereof. Preferably, the leg members are at 90° angles to each other. Further, the leg members are formed from steel or other suitable metal and provide inner and outer ends. The inner ends of the respective leg members are secured to the exterior wall of the central post 24 by any suitable means, such as by welding and the like. The outer ends of the leg members 16, 18, 20, and 22 are provided, respectively, with a ground-engaging pad 26, 28, 30 and 32.

Importantly, for stability purposes, the base 14 includes at least four radial spokes, with first and second specific pairs of the spokes or leg members 16, 18, 20 and 22 having a predetermined length. Four spokes are preferred because of the stability which they impart to the system hereof.

For purposes of understanding the present invention, as shown in FIG. 5, the leg members 16 and 18 are defined as the front or forward legs and the leg members 20 and 22 are defined as the back or rear legs. Because of the disposition of the center of gravity of the device, the rear legs 20 and 22 are of a predetermined first length, and the forward legs 16 and 18 are of a predetermined second length, with the rear legs 20 and 22 being longer than the front legs 16 and 18. Generally, to impart stability to the system, the rear legs 20 and 22 are about one and a quarter (1¼) to about one and a half (1½) times longer than the length of front legs 16 and 18.

Figure 2:
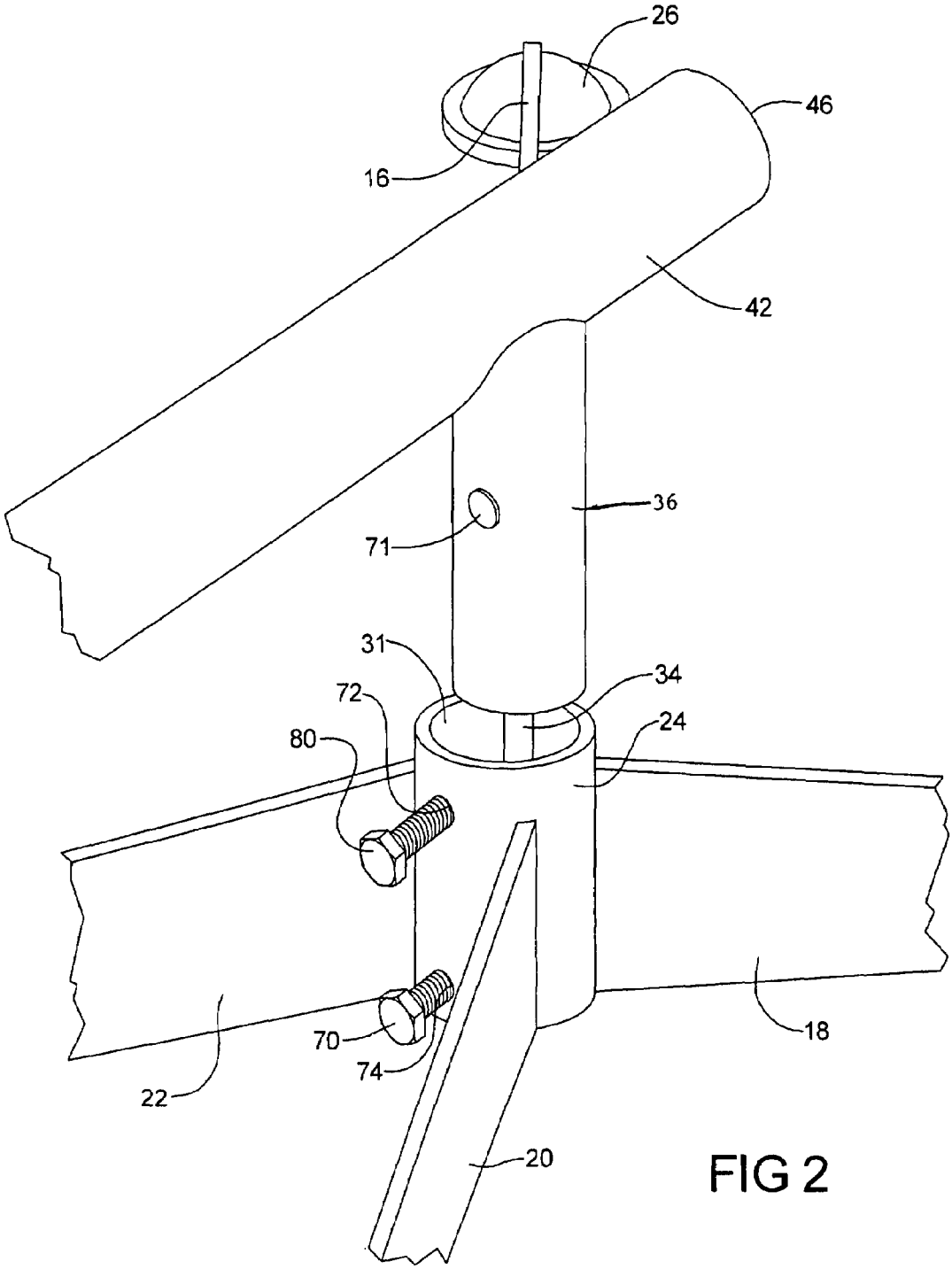
FIG. 2 is an exploded partial plan view of a base member and a frame of the frame assembly hereof, showing the mounting of the frame to the base.

FIG. 2 is an exploded partial plan view looking downwardly at the top of the base member 14 and the lower end of the frame 10 being positioned for mounting to the base. In this regard, a generally cylindrical shank 34 is disposed, in part, interiorly of the central bore of the central post 24. A lower end portion of the cylindrical shank 34 extends a predetermined distance into the bore and is fixedly attached to the central post 24 in a manner wherein to define a cylindrical annular gap 31, or receiving socket, between the exterior surface of the shank and the interior wall of the bore. The lowermost end of the shank 34 is fixedly connected to the central post 24 through any suitable means, such as by welding a support plate or the like to the post body and shank.

The upper end portion of the shank 34 extends outwardly and upwardly from the bore of the central post. The upper end portion of the shank 34 forms a male member dimensioned to be inserted into a socket formed by the tubular lowermost end portion of a cylindrical stub 36, the stub extending perpendicularly downwardly and away from the frame element 40 and slidably fittable into the gap 31. The upward extension of the shank into the stub, and the close interfitment between the stub and the socket or gap 31 in the base member provides lateral stability to the connective fitment therebetween.

The vertical axis through the post body, the annular gap 31, and the shank 34 are generally coaxial with one another. Important to this invention is that the gap, the shank, and the bore have cross-sections suitably dimensioned and complementary to the stub 36 wherein to receive the stub 36 in a close clearance fit, as described herein below.

As detailed below, to impart further structural integrity to the base 14, a set screw 70 or the like may be used to interconnect and fix the stub 36 to the shank 34 and relative to the central post 24. The set screw 70 threadably engages with the thread in the threaded aperture or opening 74 in the central post 24. The free end of the set screw 70 enters into the bore or interior annular chamber 31 in the central post 24 and laterally drives against the lowermost end of the stub 36, stabilizing and fixing the lowermost end of the stub relative to the shank 34 and the post 24. It is apparent that other means for fixedly securing and interconnecting the shank to the post may be used herein and are within the scope hereof.

The frame element 40 comprises generally hollow tubular first and second elements or frame sections 42 and 44 and the mounting stub 36. Each frame section 42 and 44 is generally curvilinear with the lower frame section 42 including opposite free ends 46 and 48 and the upper frame section 44 including opposite free ends 54 and 56. The free ends 48 and 56 are connectible ends that are adapted to enable the frame sections to be assembled together. So assembled, the frame sections 42 and 44 cooperate to form a banana or C-shaped section that extends approximately 180° between the ends 46 and 54. The tubular mounting stub 36 extends from the end 46 of the lower section 42 and enables the frame element 40 to be mounted to the base 14.

When the frame element 40 is assembled, the upper and lower frame sections 44 and 42 and the mounting stub 36 are generally coplanar. When the frame element 40 is mounted to the base 14, the sections 42 and 44 and stub 36 are disposed in a vertical plane that is perpendicular to the base 14.

The tubular stub 36 has upper and lower ends. The uppermost end of the stub 36 is fixedly secured to the lower frame element 42, proximate to the free end 46 thereof, by welding or the like. The lowermost end portion of the stub 36 extends downwardly and away from the frame element 42 and is adapted to be inserted into the annular gap 31 formed in the center post 24 between the interior wall of the bore and the exterior surface of the shank 34.

The inserted end of the mounting stub 36 is fixedly connected to the shank 34 through any suitable means. As shown in FIG. 2, a threaded fastener 80, or the like, projects through the threaded aperture or openings 72 and 71, respectively, formed in the central post 24 and the stub 36. Preferably, a threaded bore (not shown) is provided in the shank 34 to threadably receive the inwardmost end of the threaded fastener 80. The apertures in the central post 24, stub 36, and shank 34 would be radially aligned with one another to enable stabilizing receipt by the threaded fastener 80.

Desirably, the threaded fasteners 70 and 80 cooperate to fixedly orient the frame 10 relative to the base 14. In this mounting, the frame 10 is in a vertical plane, generally perpendicular to the ground and the base member 14. Importantly, the frame 10 is disposed in a plane that is approximately at a 45° angle relative the rear legs 20 and 22, as well as the front legs 16 and 18. Further, and important herein, the free end portions 54 and 46 of the upper and lower frame elements 44 and 42 and the stub 36 are generally aligned with the vertical axis through the central post 24 of the base 14.

Figure 3:
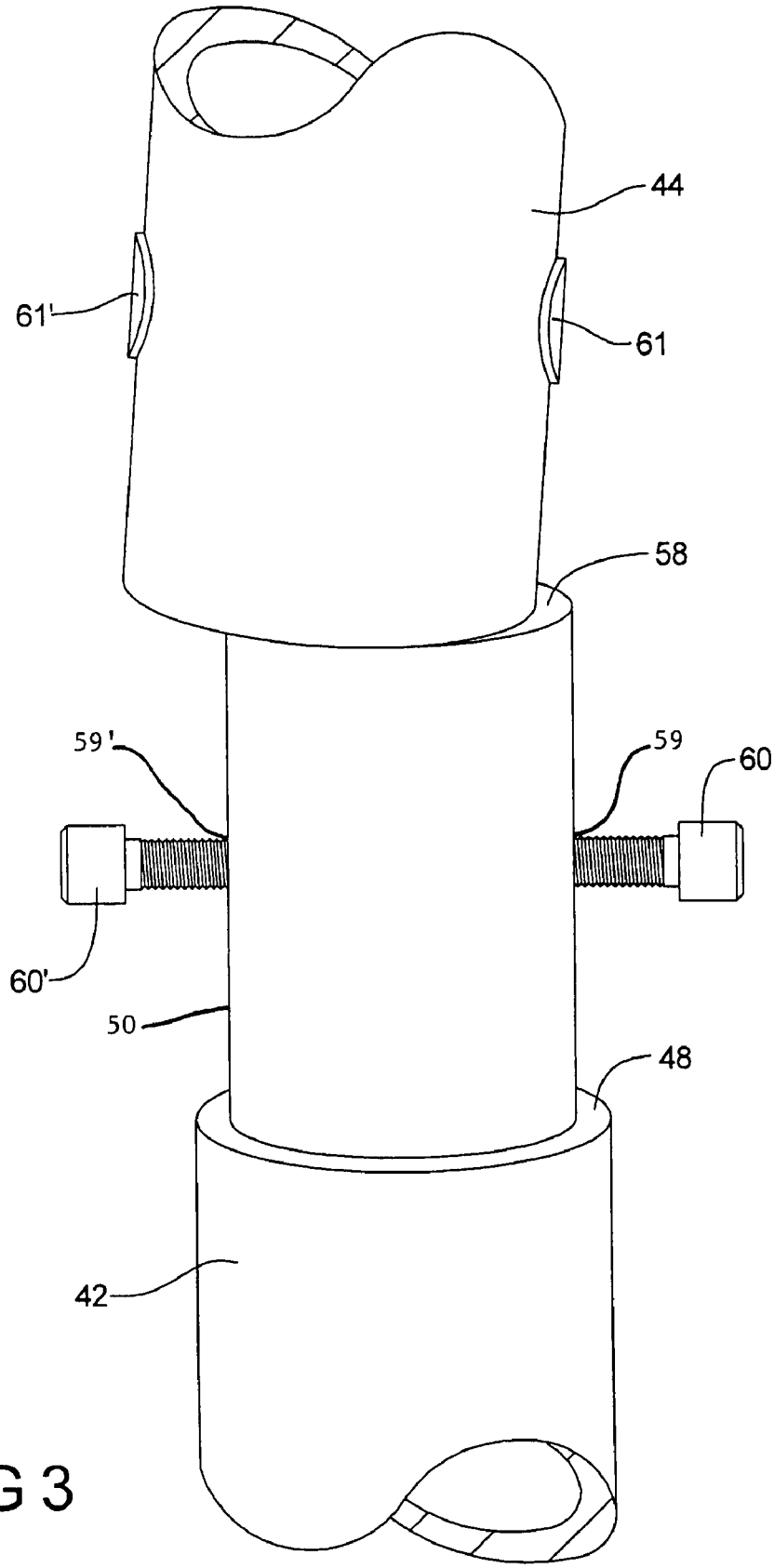
FIG. 3 is a partial elevation view of the frame, showing tubular elements of the frame being positioned for securement to one another.

Referring to FIG. 3, a tubular mounting rod or peg 50 is used to connect the frame elements 42 and 44 to one another. In the embodiment shown, a lower end portion of the peg 50 is disposed within the lowermost or first frame section 42, proximate the uppermost free end 48 thereof. The lower end portion of the mounting rod or peg 50 is internally fixed within the tubular frame section 42 via any suitable means, such as by welding or the like.

The rod 50 also has an upper end portion 58, which projects upwardly from the uppermost free end 48 of the lower frame section 42. The uppermost end portion 58 of the rod 50 has a pair of opposed openings or bores 59 and 59' formed therein. As described herein below, the bores 59 and 59' cooperate with means for fastening, to secure the upper frame element 44 to the lower frame section 42.

As shown in the FIG. 3, the upper end portion 58 of the peg 50 forms a male member, which is inserted into the interior hollow or socket provided by the second frame element 44, proximate to the free end 56 thereof. The second frame element 44 has opposed openings 61 and 61' disposed proximate the free end 56, which openings register or are aligned with an associated one of the bores 59 and 59'.

A pair of threaded fasteners, such as a threaded cap screw 60 and 60', defines the means for fastening the frame sections 44 and 42 to one another and to the peg 50. The cap screws 60 and 60' are threadingly inserted into an associated one of registering opening and bore 59 and 61 or 59' and 61', to fix the upper element 44 to the peg 50, and thus to the lower frame element 42. While two cap crews are illustrated, a single screw may be used.

Importantly, the openings 59 and 59', 61 and 61', and threaded fasteners 60 and 60' cooperate to properly orient, as well as interconnect, the frame sections 42 and 44 relative to the rear legs 20 and 22.

Figure 4:
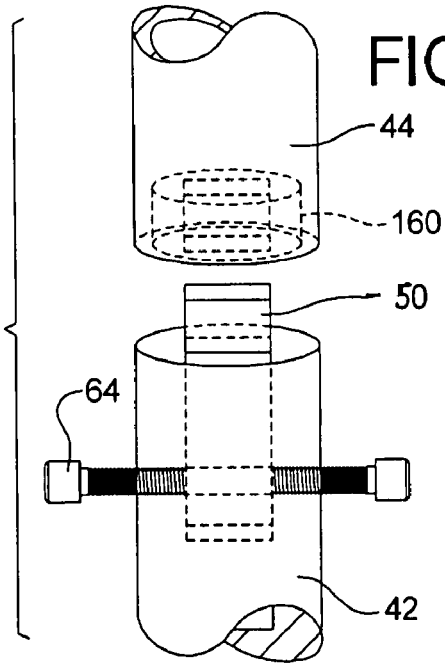
FIG. 4 is a broken view, partially in phantom, showing an alternate embodiment for securing together the tubular elements of the frame.

It should be noted and as shown in FIG. 4 that alternate means for interconnecting the upper and lower elements 44 and 42 of the C-shaped frame 10 may be used herein. For example, the mounting peg 50 may be rectangular and cooperative with a rectangular keyway 160 formed in both the upper and lower elements 44 and 42. By journalling or mounting the upper or second member 44 onto the peg 50 through the rectangular keyway disposed interiorly of the lower first element 42, rotational movement is barred thereby providing means for eliminating the threaded fasteners for securing the upper element to the lower element. However, an upper threaded fastener may still be employed, if desired. Regardless of the means for interconnecting, a rigid interconnection is provided between the upper and lower elements.

Importantly, the frame and the base member are connected in a manner that the two do not rotate relative to one another, and the frame does not move from centered relation above the rear legs 20 and 22.

Additionally, the cross-section of post and peg may be such that the apexes of the cross-section are in planes that bisect (i.e., are at 45° angles to) the right angled orientation between the front and rear legs. Such would rapidly enable the user to orient the frame 10 relative to the base 14.

Furthermore, as shown in FIG. 1 of the drawings, suspension and anchoring apparatus is provided for suspending or otherwise hanging the seating device 12 from the frame 10. As shown, a hook element 62 is provided at the free end 54 of the upper or second tubular element 44. The hook may be secured thereto by any suitable method, such as by welding or the like, as shown. The hook element 62 provides a substantially single point connection, about which the seat element may rotate.

Further, the hook 62 may be used in connection with a chain, link element, and the like. Such connection would enable vertical adjustable connection or coupling to be effectuated between the hook of the frame 10 and a corresponding connecting element of the seating structure. Such hanging suspension would, depending on the application and nature of the seating device, allow the seat to swing to and fro relative to the suspension or hanging arrangement.

As shown in FIG. 5, the frame 10 is shown in relation to the base 14 and the chair 12. It should be noted in this regard that in assembling the chair 12 with the present frame 10 that the tubular frame, per se, be disposed substantially centrally of the space between the rear legs 20 and 22. Such arrangement is important in centering and suspending the chair 12 and the user above the ground and for a front-to-back pendular motion relative to the frame assembly when supported on the ground. Such positioning places the center of gravity of the seat, the user relative to the suspension to inhibit the assembly from tipping over as the seat device moves forwardly and rearwardly relative to the suspension.

By providing the separable upper and lower frame elements 44 and 42, packaging of the frame element 40 is enhanced, and since the base 14 is removable from the frame assembly 10, the two frame elements 42 and 44 can be packaged together or separately from the base 14, enabling different frame configurations to be marketed, as desired.

In fabricating the present invention, all of the components are preferably made of steel or aluminum, although other materials of construction may be used.

It is to be appreciated from the preceding that there has been disclosed herein a frame for suspending a seating device therefrom which overcomes the deficiencies in the prior art.

What I claim is:

1. A frame assembly for suspending a chair above the ground and for a front-to-back pendular motion relative to the frame assembly when supported on the ground, the frame assembly comprising:

a base member, said base member including a central support having a central vertical axis and a plurality of base legs for supporting the base member on the ground, said legs being disposed along respective radii and radiating outwardly from said central support and the axis thereof, an arcuate two-part support frame, said support frame comprising an upper and a lower frame element, each frame element being generally curvilinear and including a first end and a second end, first means for releasably connecting the first end of the lower frame element to the second end of the upper frame element, wherein to form said support frame, and second means for releasably connecting the second end of the lower frame element to said central support of said base member, wherein the first end of the upper frame element is substantially aligned with the vertical axis of said central support of the base member.

2. The frame assembly of claim 1, wherein said second means comprises:

means for orienting and stabilizing the second end of the lower frame element relative to the base member, said means for orienting and stabilizing aligning the first end of the upper frame element and the second end of the lower frame element with the central vertical axis of the central support.

3. The frame assembly of claim 2, wherein said means for orienting and stabilizing comprises:

said base member including a wall forming a central chamber and a pair of vertically spaced bores extending radially through said wall and opening in said chamber, a tubular stub extending from the second end portion of said lower frame element, said stub being dimensioned for coaxial fitment within said chamber, and a pair of threaded fasteners, said fasteners being adapted to pass through a respective bore and threadably interconnect the stub with the base member.

4. The frame assembly of claim 3, wherein:

said vertically spaced bores include a threaded first bore proximate to the ground and a second bore distal to the ground and said stub includes a threaded third bore distal to the ground, when the support frame is supported on the ground, said third bore being adapted to register with said second bore when the stub is disposed in said chamber, wherein one threaded fastener is adapted to threadably connect to said first bore and be driven radially inwardly and against the stub to drive the stub into engagement with the chamber wall, and wherein the other threaded fastener is adapted to pass through the second bore and into threadable connection with the threaded third bore.

5. The frame assembly of claim 1, wherein the leg members are at 90° angles to one another and comprise a pair of front legs, each of a first length, and a pair of back legs, each of a second length, the second length being greater than the first length.

6. The frame assembly of claim 5, wherein the back legs and the second length thereof is approximately 1¼ to 1½ times greater than the first length of said front legs.

7. The frame assembly of claim 6, further comprising means for centering the support frame in the 90° sector extending vertically above and between the two back legs.

8. The frame assembly of claim 1, wherein said first means comprises a male member and a receiving socket provided in one and the other of said upper and lower frame elements, the male member extending from one frame element and received in the socket formed at the end of the other frame element.

9. The frame assembly of claim 8, wherein the first means further comprises:

means for fixedly attaching the second end of the upper frame element to the first end of the lower frame element, the means for fixedly attaching comprising a threaded fastener extending radially through the tubular wall forming the socket of said other frame element and into the male member of said one frame element when said male member is in said socket.

10. The frame assembly of claim 8, wherein the male member and the socket are provided with squared cross-sections, wherein interfitment therebetween inhibits relative rotation therebetween.

11. The frame assembly of claim 1, further comprising third means for releasably connecting a seat element in hanging suspended relation to the first end of the upper frame element.

12. The frame assembly of claim 11, wherein the third means for releasably connecting comprises a hook element provided at the first end of the upper frame element, the hook being centered along the vertical axis of the base member.

13. The frame assembly of claim 12, wherein the means for connecting further comprises link structure for varying the distance between the hook and the seat element.

14. The frame assembly of claim 1, wherein the upper and lower frame elements are curvilinear and assemble into a continuous curve having a banana shape.

15. In combination:

a seating element, and a suspension frame assembly, said frame assembly comprising a base member adapted to be supported on the ground, the base member including a pair of rear legs and a pair of front legs, the legs radiating outwardly from the base member with the rear legs being longer than the front legs, a two-piece support member, including an upper and a lower frame element, means for connecting the frame elements to one another to form a C-shaped frame disposed in a common plane and having first and second ends, the frame elements being non-rotatable relative to one another, a stub for connecting a first end of said support member to said base member in a manner that the plane of the support member is perpendicular to the ground and bisects the angle between the rear legs, the stub and support member being non-rotatable relative to one another, the support member being disposed substantially entirely in the bisected sector above the rear legs, and means for suspending the seating element above the base member and from a second end of the support member, the means for suspending being such that the seating element is suspended from the upper frame element above the base member for a front-to-rear pendular motion and is aligned on a common vertical axis extending through the second end of the support member and the stub of the base member.

16. A frame assembly for suspending a chair above the ground and for a front-to-back pendular motion relative to the frame assembly when supported on the ground, the frame assembly comprising:

a base member, said base member including a central support having a central vertical axis and a plurality of base legs for supporting the base member on the ground, said legs being disposed along respective radii and radiating outwardly from said central support and the axis thereof, said base member further including a wall forming a central chamber and a pair of vertically spaced bores extending radially through said wall and opening in said chamber, an arcuate two-part support frame, said support frame comprising an upper and a lower frame element, each frame element being generally curvilinear and including an upper first end and a lower second end, first means for releasably connecting the upper first end of the lower frame element to the lower second end of the upper frame element, wherein to form said support frame, and second means for releasably connecting the lower second end of the lower element to said base member, wherein said second means comprises means for orienting and stabilizing the lower second end of the second frame element relative to the base member, said means for orienting and stabilizing align the upper first end of the upper frame element and the lower second end of the lower frame element with the central vertical axis of the central support, said means for orienting and stabilizing comprises the base member including the wall forming the central chamber and the pair of vertically spaced bores extending radially through the wall and opening in the chamber, a tubular stub extending from the lower end portion of said lower frame element, said stub being dimensioned for fitment within said chamber, and a pair of threaded fasteners, each adapted to pass through one respective bore and threadably interconnect the stub with the base member.

* * * * *